US009909360B2

(12) United States Patent
Goldberg

(10) Patent No.: US 9,909,360 B2
(45) Date of Patent: Mar. 6, 2018

(54) BATTEN SPACERS FOR SHADE SYSTEMS

(71) Applicant: HUNTER DOUGLAS INC., Pearl River, NY (US)

(72) Inventor: Michael S. Goldberg, Pearl River, NY (US)

(73) Assignee: HUNTER DOUGLAS INC., Pearl River, NY (US)

( * ) Notice: Subject to any disclaimer, the term of this patent is extended or adjusted under 35 U.S.C. 154(b) by 0 days.

(21) Appl. No.: 14/941,381

(22) Filed: Nov. 13, 2015

(65) Prior Publication Data

US 2016/0138329 A1 May 19, 2016

Related U.S. Application Data

(60) Provisional application No. 62/081,456, filed on Nov. 18, 2014, provisional application No. 62/081,554, filed on Nov. 18, 2014.

(51) Int. Cl.

| | |
|---|---|
| ***A47H 5/00*** | (2006.01) |
| ***E06B 3/48*** | (2006.01) |
| ***E06B 3/94*** | (2006.01) |
| ***E06B 9/06*** | (2006.01) |
| ***E06B 9/262*** | (2006.01) |

(52) U.S. Cl.

CPC ..... *E06B 9/262* (2013.01); *E06B 2009/2622* (2013.01)

(58) Field of Classification Search

CPC .. E06B 9/262; E06B 2009/2622; E06B 9/324; E06B 2009/3265; E06B 9/326

See application file for complete search history.

(56) References Cited

U.S. PATENT DOCUMENTS

| | | | | |
|---|---|---|---|---|
| 4,921,032 | A | 5/1990 | May | |
| 5,273,096 | A * | 12/1993 | Thomsen | E06B 9/262 160/264 |
| 6,257,300 | B1 * | 7/2001 | Brownlie | A47H 23/00 160/264 |
| 6,676,096 | B2 * | 1/2004 | Hung | B66F 5/00 248/231.81 |
| 8,540,006 | B1 * | 9/2013 | Vestal | E06B 9/38 160/340 |
| 2004/0108078 | A1 * | 6/2004 | Chen | E06B 9/262 160/84.01 |
| 2010/0252209 | A1 | 10/2010 | Wang | |
| 2011/0067820 | A1 * | 3/2011 | Hsu | E06B 9/262 160/84.03 |
| 2011/0108206 | A1 | 5/2011 | Hsu et al. | |

(Continued)

FOREIGN PATENT DOCUMENTS

WO WO 2010/009513 1/2010

*Primary Examiner* — Katherine W Mitchell
*Assistant Examiner* — Jeremy C Ramsey
(74) *Attorney, Agent, or Firm* — Dority & Manning, P.A.

(57) ABSTRACT

The present invention provides a shade assembly which comprises a shade fabric and a plurality of battens arranged vertically with respect to one another, each batten aligned horizontally along the fabric and forming a pleat therewith. A plurality of spacers are also provided which are coupled to and positioned adjacently to one of the plurality of battens in a direction perpendicular to a plane of the shade fabric. The plurality of spacers maintains the plurality of battens in a substantially vertical arrangement when the shade fabric is drawn into an open position.

15 Claims, 8 Drawing Sheets

(56) References Cited

U.S. PATENT DOCUMENTS

| | | | | |
|---|---|---|---|---|
| 2011/0203080 | A1* | 8/2011 | Hailes | E06B 9/262 24/457 |
| 2011/0297335 | A1 | 12/2011 | Su | |
| 2011/0297338 | A1* | 12/2011 | Chen | E06B 9/262 160/340 |
| 2014/0284003 | A1 | 9/2014 | Cha | |

* cited by examiner

BATTEN SPACERS FOR SHADE SYSTEMS

CROSS-REFERENCE TO RELATED APPLICATIONS

This patent application claims the benefit of priority to U.S. Provisional Patent Application No. 62/081,456 filed Nov. 18, 2014 and to U.S. Provisional Patent Application No. 62/081,554 filed Nov. 18, 2014, the contents of which are

FIELD OF THE INVENTION

The present invention relates to window shade or blind systems, and in particular relates to batten spacers adapted for use in roman shade systems and assemblies.

BACKGROUND

Roman window shade systems and assemblies include a shade and/or a backing fabric that is adapted to fold into a plurality of horizontal pleats as the shade is opened. The pleats are formed using rigid battens or sewn-in dowels or combinations of such elements. FIG. 1 shows a photograph of a side view of an example roman shade 10 in a fully opened position. In this opened position, the shade 10, which typically disposed on the back of the assembly toward a window (not shown), forms a plurality of folds, e.g., 12, 14, 16, and the battens, e.g., 22, 24, 26 to which they are coupled are collectively drawn into a backwards-J configuration. As the folds are compressed and forced backwards, they may come into contact with the window surface and accumulate condensation, and the contact with the window, trim and/or walls will push the stack of battens forward. For this reason, and also because the shade assembly can become unsightly and otherwise difficult to manipulate and release when the folds 12, 14, 16 become bunched in the manner shown, it would be useful to provide a means for a roman shade assembly to be opened fully without becoming distended in this disadvantageous way.

SUMMARY OF THE INVENTION

The present invention provides a shade assembly which comprises a shade fabric and a plurality of battens arranged vertically with respect to one another, each batten aligned horizontally along the fabric and forming a pleat therewith. A plurality of spacers are also provided which are coupled to and positioned adjacently to one of the plurality of battens in a direction perpendicular to a plane of the shade fabric. The plurality of spacers maintains the plurality of battens in a substantially vertical arrangement when the shade fabric is drawn into an open position.

According to one embodiment, the present invention also provides a batten spacer for a shade system including a plurality of battens, the batten spacer comprising an upper portion, a lower portion, and a planar element connecting the upper and lower portions. The upper and lower semicircular portions and the planar element define an interior space adapted to receive an annular element; a height from a bottom of the lower semicircular portion to a top of the upper semicircular portion is approximately the same as a height of one of the plurality of battens.

According to another embodiment, the present invention provides a batten spacer for a shade system including a plurality of battens, the batten spacer comprising a cylindrical annulus having a height that is approximately the same as a height of one of the plurality of battens, and a planar element extending tangentially to the cylindrical annulus, the planar element adapted to couple to cooperating receiving elements on the plurality of battens Other features and advantages of the present invention will become apparent from the following description of the invention that refers to the accompanying drawings.

BRIEF DESCRIPTION OF THE DRAWINGS

The invention will now be described in greater detail in the following detailed description with reference to the drawings in which.

DETAILED DESCRIPTION OF THE INVENTION

Figure 1:
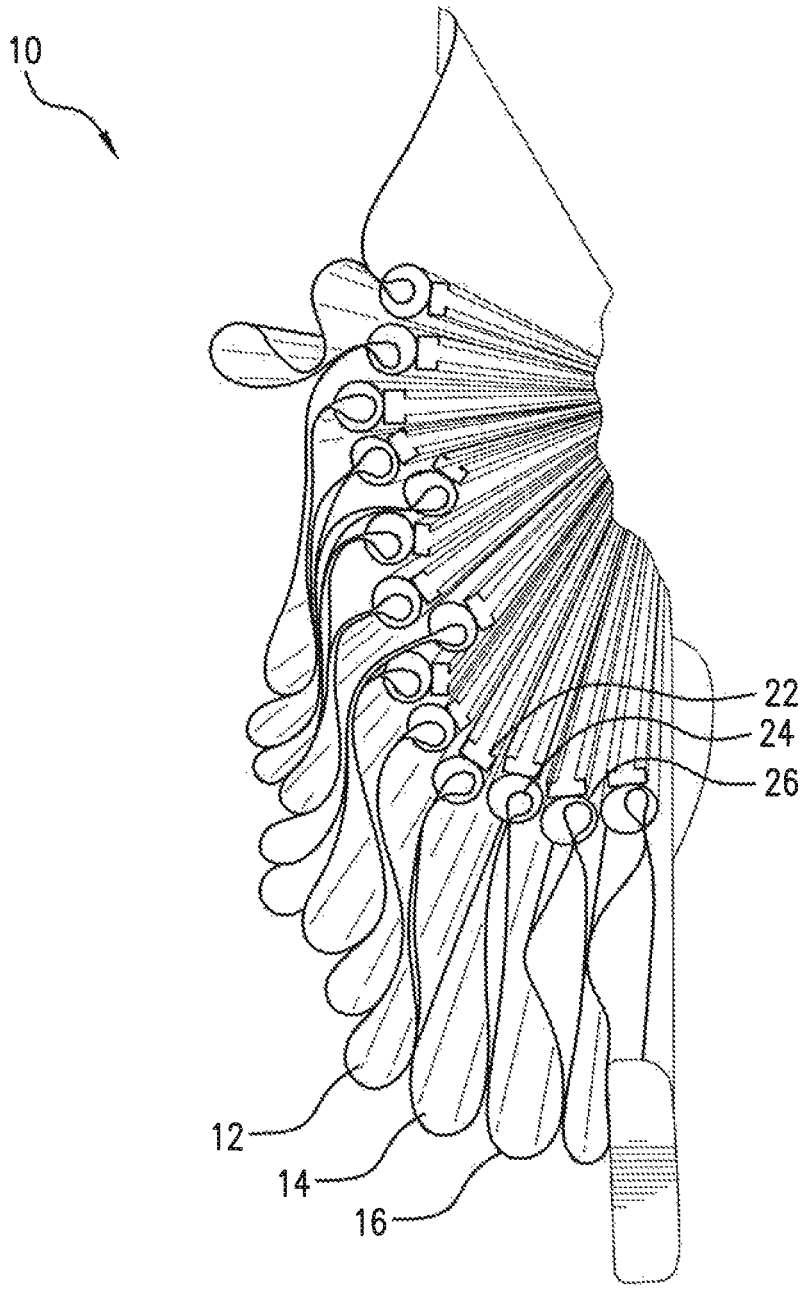
FIG. 1 Prior Art
FIG. 1 is a photograph of a side view of an example roman shade assembly according to the prior art in a fully opened position.

The foregoing summary, as well as the following detailed description of the embodiments of the present invention, is better understood when read in conjunction with the appended drawings. For the purposes of illustrating the invention, there is shown in the drawings an embodiment that is presently preferred, in which like numerals represent similar parts throughout the several views of the drawings, it being understood, however, that the invention is not limited to the specific methods and instrumentalities disclosed.

It will be understood that when an element is referred to as being "coupled" or "connected" to another element, it can be directly coupled or connected to the other element or intervening elements may also be present. In contrast, when an element is referred to as being "directly coupled" or "directly connected" to another element, there are no intervening elements present.

Figure 2:
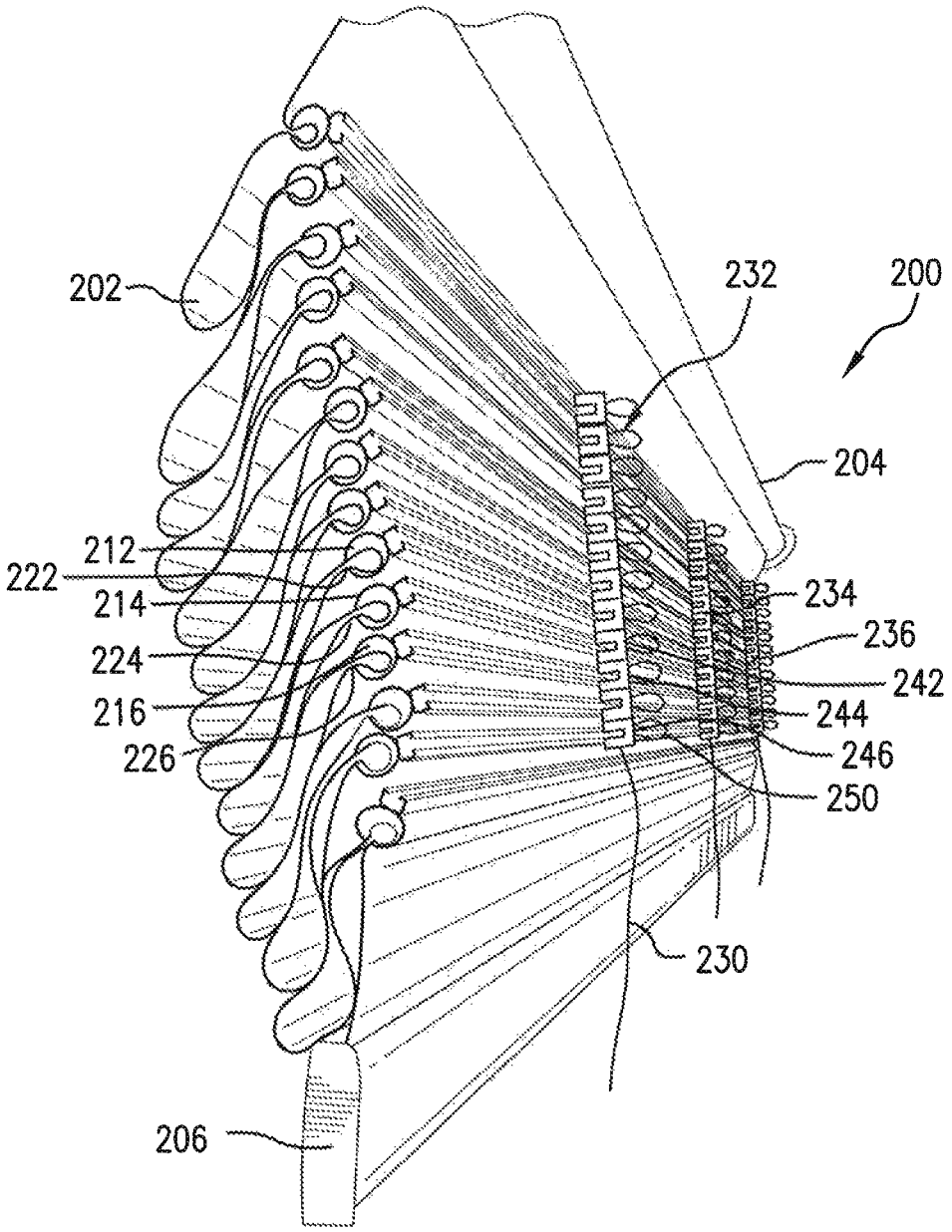
FIG. 2 is a photograph of a side view of an example roman shade assembly with batten spacers according to the present invention.
Figure 3:
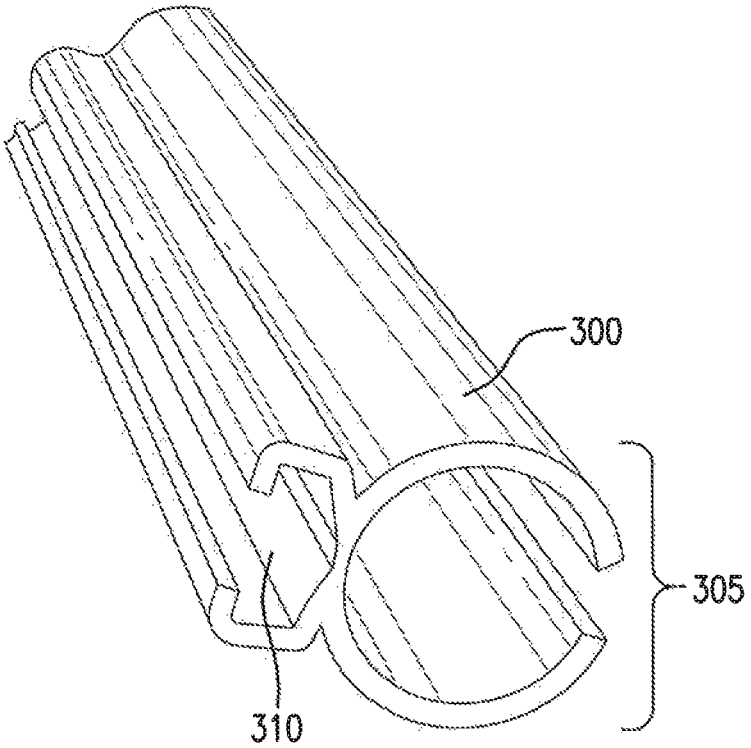
FIG. 3 is a photograph of an end view of an example batten according to an embodiment of the present invention.

FIG. 2 shows a photograph of a side an example shade assembly 200 according to an embodiment of the present invention, illustrating its contrast with the existing art shown in FIG. 1. The shade assembly 200 includes a shade fabric 202, coupled at a top end to a roller tube 204 and to a bottom panel 206. Along the length of the fabric, a plurality of battens, e.g., 212, 214, 216, are detachably coupled to the shade fabric 202 by pincer-like clamp elements that may clamp around dowel elements sewn in to the shade fabric 202 or simply clamp the shade fabric itself. FIG. 3 is a photograph showing an end view of a batten 300 according to one particular embodiment of the present invention. As shown, the end of the batten 300 includes a first, larger pincer element 305 adapted to couple to the shade fabric and a second pincer element 310 which may form a track along the length of the batten to receive other coupling elements, as discussed further below. At the points where the plurality of battens, e.g., 212, 214, 216 couple to the shade fabric, pleats e.g. 222, 224, 226 are formed. The shade assembly 200 may be lifted or lowered by use of one or more lift cords e.g., 230 positioned along the horizontal length of the assembly. The lift cord 230 may be coupled, for example, to the bottom batten so that when the cord is pulled, the bottom batten is raised up to and pushes on the next lowest batten on so on, raising the entire assembly.

Positioned at intervals along the assembly 200 are stacks of batten spacers, 232, 234, 236, each of composed of a plurality of individual spacers (e.g., a first stack 232 includes spacers 242, 244, 246). Each stack 232, 234, 236 includes one spacer for every batten e.g., 212, 214, 216, and each spacer e.g., 242, 244, 246 is coupled to one of the respective battens. The spacers 242, 244, 246 are formed to have heights (in the vertical direction) approximately equivalent to the battens to which they couple. As shown in FIG. 2, the stacks of 232, 234, 236 battens act as semi-rigid 'spines' preventing the assembly 200 from collapsing or distending in the manner shown in FIG. 1. Rather, as indicated in FIG. 2, when the shade assembly is opened, the plurality of battens remain in a substantially vertical arrangement instead of bending into a J-shape.

In some embodiments of the present invention, the spacers e.g., 242, 244, 246 do not couple directly to the plurality of battens, but rather, are each adapted to receive annular ring elements (not shown in FIG. 2), which in turn couple to the battens. Among the advantages of using annular elements, are that the lift cord can be made to run through the elements, preventing the lift cords from being manipulated in other directions aside from up and down. Shroud cords, e.g., 250, which further prevent unintended extensions of the lift cord can also be attached to the annular elements, providing safety features.

Figure 4C:
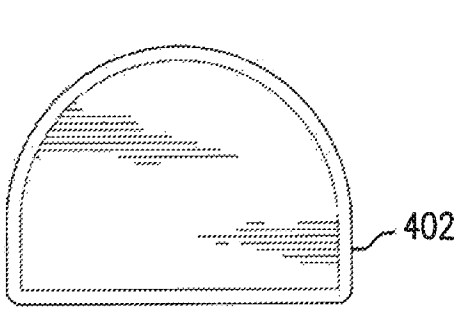
FIG. 4C is a top (or bottom) plan view illustration of a batten spacer according to one embodiment of the present invention.
Figure 4B:
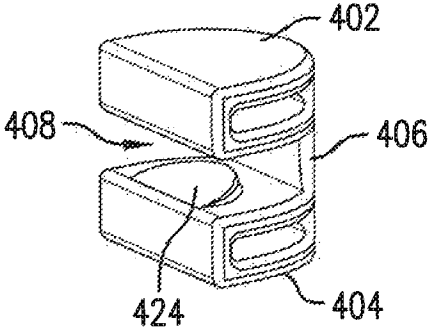
FIG. 4B is another perspective view illustration of a batten spacer according to one embodiment of the present invention.
Figure 4A:
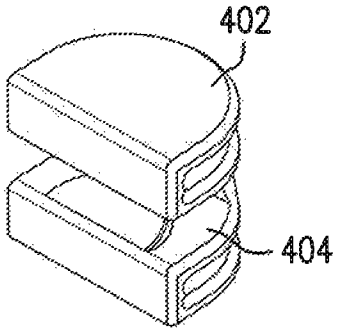
FIG. 4A is a perspective view illustration of a batten spacer according to one embodiment of the present invention.
Figure 4E:
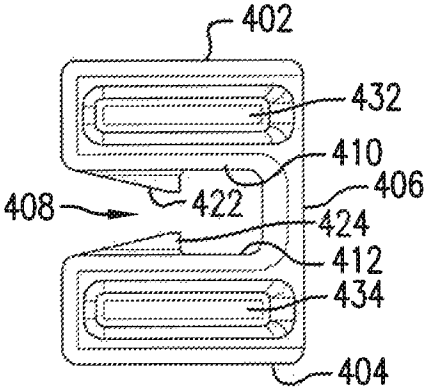
FIG. 4E is a side plan view illustration of a batten spacer according to one embodiment of the present invention.
Figure 4D:
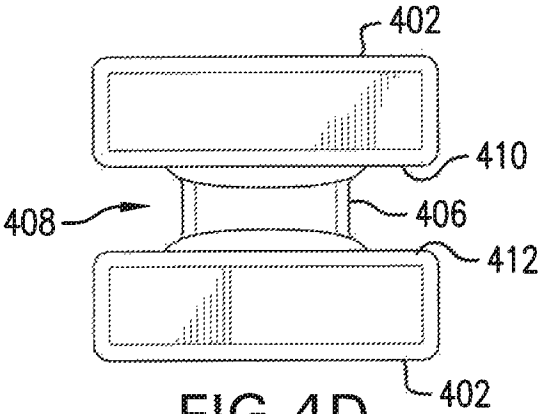
FIG. 4D is a front plan view illustration of a batten spacer according to one embodiment of the present invention.

FIGS. 4A-4E are engineering drawings of an embodiment of a batten spacer 400 according to an embodiment of the present invention. As shown in the perspective views of FIGS. 4A, 4B, batten spacer 400 includes an upper semicircular portion 402, and a lower semicircular portion 404, mutually connected at their curved portions via a planar element 406. These elements bound an interior space 408 between the upper and lower portions adapted to receive and couple to an annular element (not shown). FIG. 4C shows a top or bottom plan view indicating a substantially semicircular design of the top and bottom surfaces, and FIG. 4D shows a frontal plan view clearly indicating the upper 402 and lower 404 portions and the receiving space between 408. FIG. 4E is a side plan view indicating a C-shaped cross-section of the exemplary batten spacer 400. As clearly shown in the perspective view of FIG. 4B and also the side plan view of FIG. 4E, the bottom surface 410 of the upper semicircular potion 402 and the top surface 412 of the lower semicircular portion 404 include respective inclined protruding elements 422, 424 that are adapted to provide a snap-fit connection with cooperating portions of an annular element. In addition, as the side view of FIG. 4C most clearly indicates, the upper and lower portions may contain hollow sections. It should be noted that the design of the batten spacer shown in FIGS. 4A-4E is by way of example and numerous modifications or alterations could be made to the batten spacer depicted and still remain within the scope of the present invention. For example, batten spacer as a whole can be formed in a different shape, and the upper and lower portions of the batten spacer in particular may be formed in another shape, for example, angled rather than semi-circular.

Figure 5:
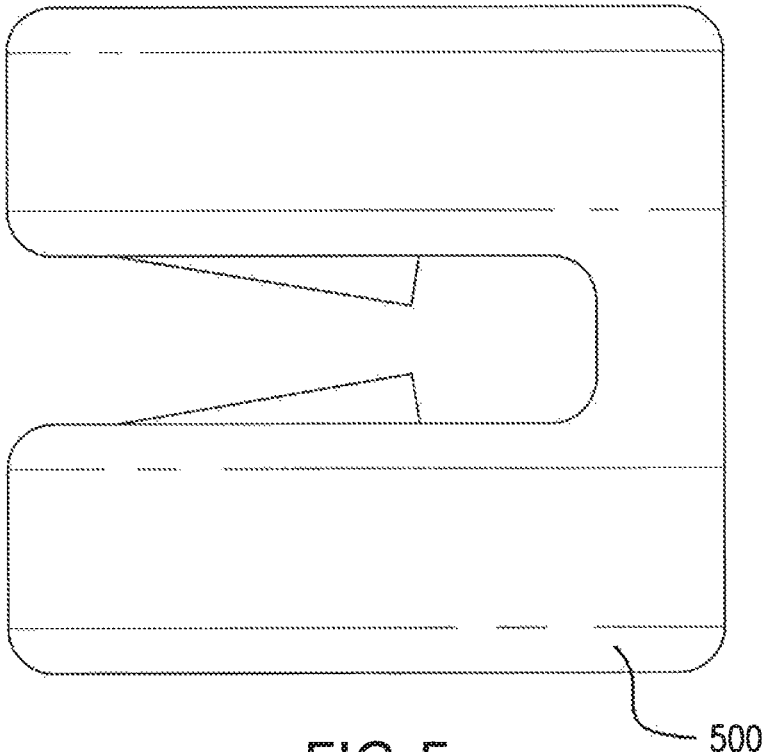
FIG. 5 is a photograph of a side view of an example batten spacer according to one embodiment of the present invention, indicating an example scale of the spacer.

FIG. 5 is a photograph of a side view of an example batten spacer 500 according to the embodiment of the present invention shown in FIGS. 4A-E. The size of batten spacer of FIG. 5 is adapted for battens of a particular height of approximately 0.5 inches. While it is anticipated, given the heights of battens typically employed in roman shade assemblies, that the batten spacers between 0.06 and 1.00 inches in height may be used, these dimensions are not to be taken as limiting as the size of the batten spacers should be adapted to and match the height of the battens in any given shade assembly. The batten spacer may be formed from any suitably lightweight and substantially rigid material, such as a plastic.

Figure 6:
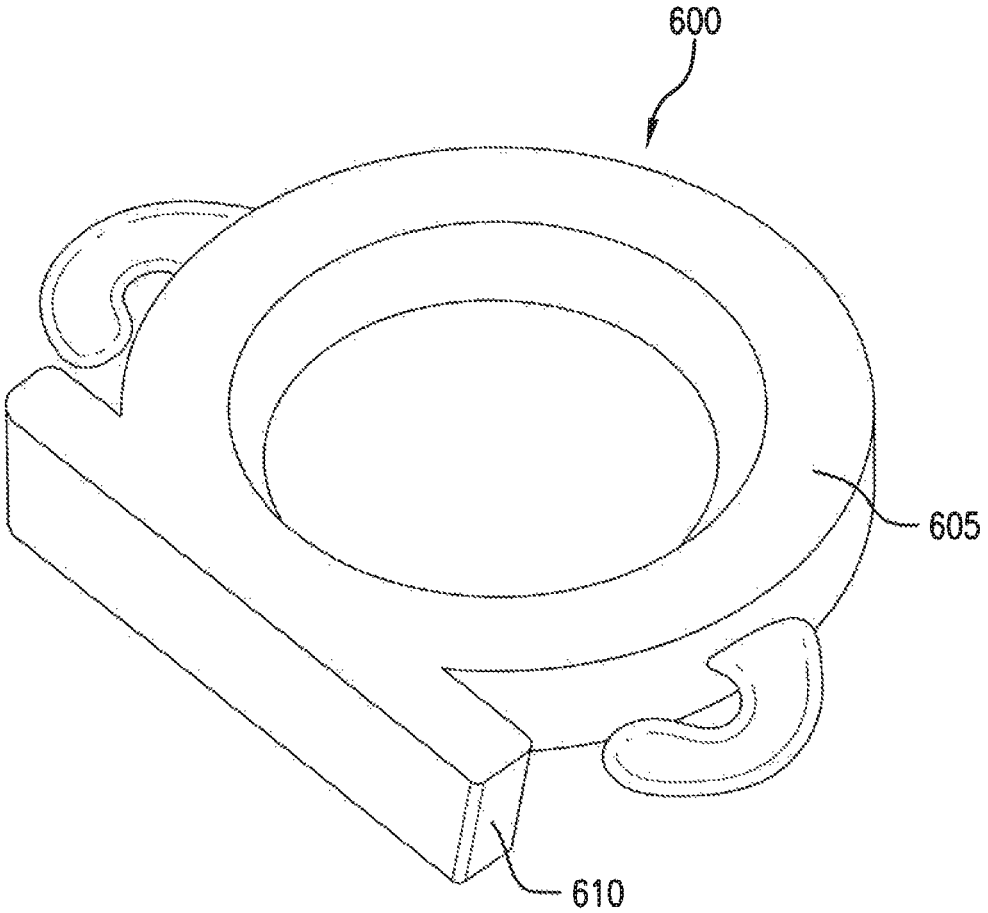
FIG. 6 is a photograph of an example annular element adapted to couple to a batten spacer according to an embodiment of the present invention.

FIG. 6 is a photograph showing a top view of an example annular element 600 adapted to couple to the batten spacers with the plurality of battens. The annular element includes a ring or annulus portion 605 adapted to be received in space 408 of the batten spacer. The annulus portion 605 may be secured in the receiving space 408 by snap-fit by virtue of the protruding elements 422,424 or otherwise securely coupled in the receiving space. In some embodiments, the annular portion 605 may have an inner diameter of approximately 0.3 to 0.4 inches and an outer diameter of 0.5 to 0.6 inches. Shade system cords, including the lift cords may extended through the central hollow region of the annular element. Shroud cords may run through the central region and/or may be directly attached to the annular element 600. The annular element 600 also includes a planar element 610 that extends in a tangential direction on an outer edge of the annular portion 605. Planar element 610 may be used to couple the annular element 600 to one of the plurality of battens of a shade assembly. According to one embodiment, mentioned above, planar element 610 may be inserted into a track formed within the extending pincer element 310 of a batten as shown in FIG. 3. By this means, the annular element 600, and the batten spacer, e.g. 500, in which it is received, may be securely coupled to one of the battens of the shade assembly.

Figure 7:
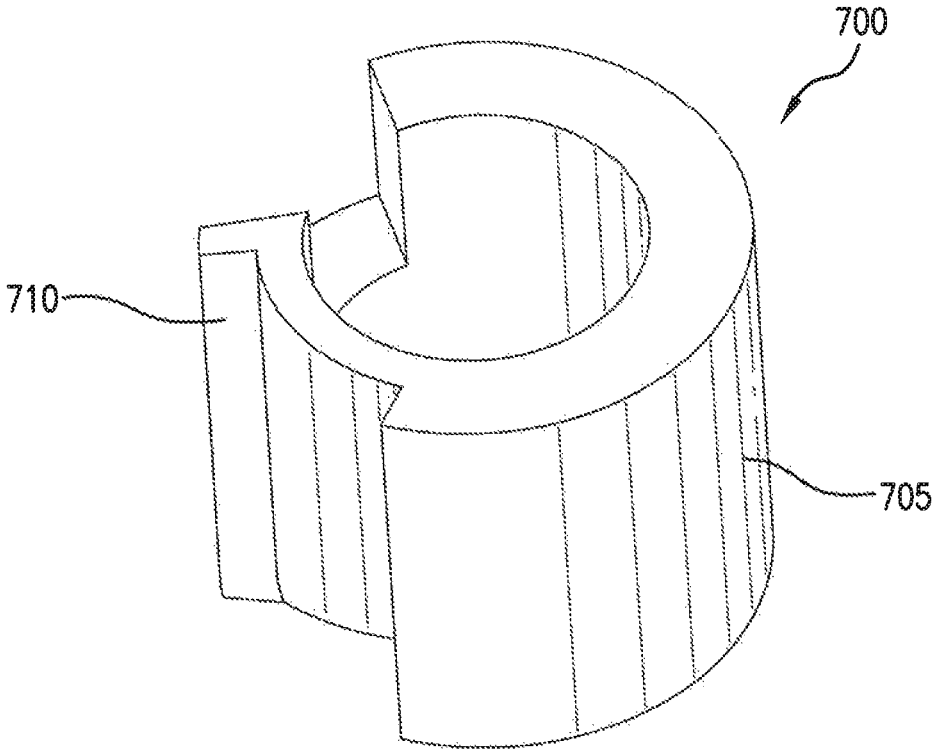
FIG. 7 is a photograph of an example annular batten spacer according to another embodiment of the present invention.

FIG. 7 shows a batten spacer according to another embodiment of the present invention, in which the functions of the spacer and annular element are combined in a single element. As shown, batten spacer 700 includes a annular portion 705, which is cylindrical in the embodiment shown, having a height adapted to match the heights of the plurality of battens in the shade assembly, and a planar element 710 that extends in a tangential direction on an outer edge of the annular portion. The planar element may be inserted to into a track formed within the extending pincer element 310 of a batten as shown in FIG. 3. By this means, the annular element 600, and the batten spacer, e.g. 500, in which it is received, may be securely coupled to one of the battens of the shade assembly.

Figure 8:
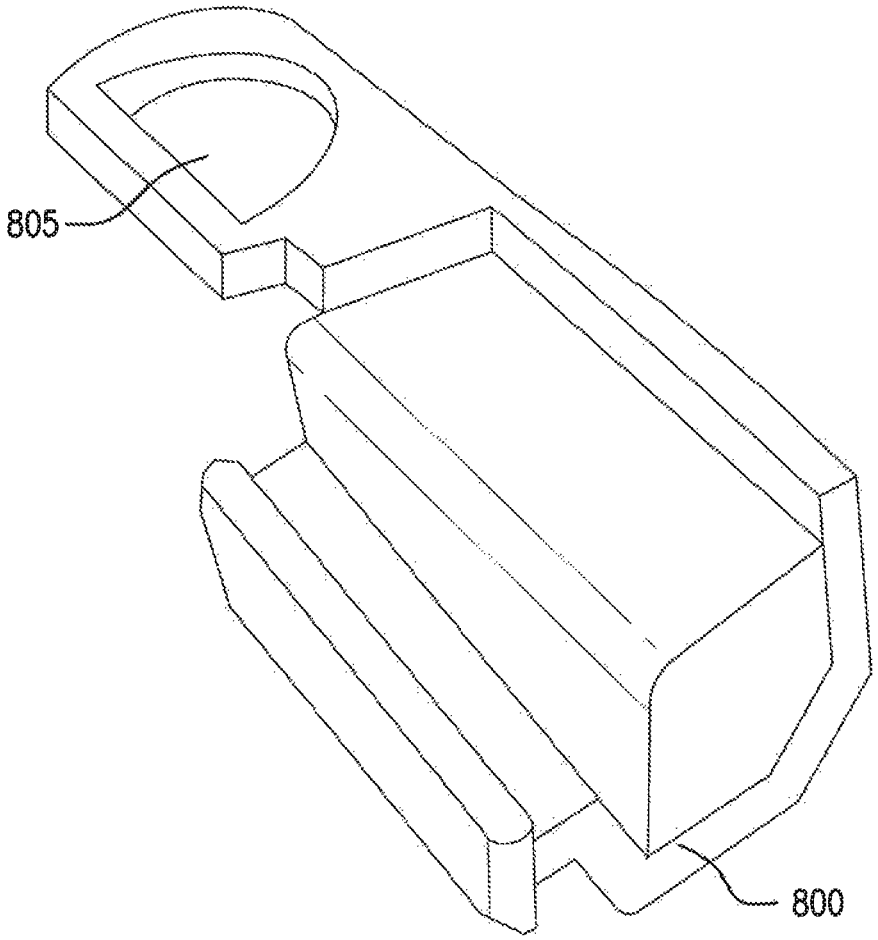
FIG. 8 is a photograph of an embodiment of a batten spacer element according to another embodiment of the present invention.

FIG. 8 shows a batten spacer 800 according to yet another embodiment of the present invention. The batten spacer 800 has a height adapted to match the battens of the shade assembly and includes a hole 805 through which a cord (e.g., the shroud cord) may be threaded to secure the spacer from moving substantially in horizontal direction. However, other means may be used to secure the spacer 800 for undue horizontal movement such as staples, glue, a snap fit to the battens, etc. Batten spacers 800 may be positioned adjacent to annular elements 600 in a shade assembly and may be coupled directly to the annular elements (e.g., via a cord) or may not be directly coupled, depending on the implementation.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. A shade assembly, comprising:

a shade fabric;

a cord operatively coupled to the shade fabric;

a plurality of battens arranged vertically with respect to one another, each batten aligned horizontally along the fabric and forming a pleat therewith;

a plurality of annular elements, each annular element including an end portion and an annulus portion extending from the end portion, the end portion of each annular element being coupled to a respective one of the plurality of battens;

a plurality of spacers, each spacer coupled to the annulus portion of a respective one of the plurality of annular elements;

wherein:

the plurality of spacers maintain the plurality of battens in a substantially vertical arrangement when the shade fabric is drawn into an open position; and the cord is received through the annulus portion of each annular element at a location between the end portion of each annular element and the respective spacer without passing through the respective spacer.

2. The shade assembly of claim 1, wherein each of the plurality of spacers defines a height that is approximately the same as a height of the respective battens to which they are coupled.

3. The shade assembly of claim 2, wherein the heights of each of the plurality of spacers range from 0.06 inches to 1.00 inches.

4. The shade assembly of claim 1, wherein each of the plurality of spacers has a c-shaped cross-section.

5. The shade assembly of claim 1, wherein:

the end portion of each annular element corresponds to a planar element configured to be coupled to the respective one of the plurality of battens.

6. The shade assembly of claim 1, wherein:

each spacer includes an upper portion and a lower portion spaced apart from the upper portion such that an open space is defined between the upper and lower portions; and the annulus portion is configured to be at least partially received within the open space between the upper and lower portions.

7. The shade assembly of claim 6, wherein:

the upper portion of each spacer includes a first protruding element extending from the upper portion into the open space; and the lower portion of each spacer includes a second protruding element extending from the lower portion into the open space; and the first and second protruding elements are configured to engage the annulus portion so as to retain the annulus portion within the open space between the upper and lower portions.

8. The shade assembly of claim 7, wherein the annulus portion is configured to snap between the first and second protruding elements when inserting the annulus portion into the open space.

9. The shade assembly of claim 5, wherein the end portion of each annular element is configured to be received within a track defined by the respective one of the plurality of battens.

10. The shade assembly of claim 1, wherein:

each spacer extends vertically between a top end and a bottom end thereof; and when the shade fabric is drawn into an open position, the plurality of spacers stack one on top of another end-to-end such that the top end of one spacer of the plurality of spacers contacts the bottom end of an adjacent spacer of the plurality of spacers.

11. The shade assembly of claim 10, wherein each of the plurality of spacers defines a height that is approximately the same as a height of the respective battens to which they are coupled.

12. The shade assembly of claim 10, wherein each spacer includes an upper portion defining the top end of the spacer and a lower portion defining the bottom end of the spacer.

13. The shade assembly of claim 12, wherein, when the shade fabric is drawn into the open position, the plurality of spacers stack one on top of another end-to-end such that the upper portion of one spacer of the plurality of spacers extends parallel to the lower portion of an adjacent spacer of the plurality of spacers.

14. The shade assembly of claim 12, wherein the upper portion is spaced apart from the lower portion such that an open space is defined between the upper and lower portions of each spacer.

15. The shade assembly of claim 10, wherein the plurality of spacers are configured to stack one on top of another end-to-end such that a semi-rigid spine is formed along one side of the shade assembly.

* * * * *